US009488429B1

(12) United States Patent
Langner

(10) Patent No.: US 9,488,429 B1
(45) Date of Patent: Nov. 8, 2016

(54) METHODS AND APPARATUS FOR DISRUPTER RECOVERY

(71) Applicant: F. Richard Langner, Fountain Hills, AZ (US)

(72) Inventor: F. Richard Langner, Fountain Hills, AZ (US)

( * ) Notice: Subject to any disclaimer, the term of this patent is extended or adjusted under 35 U.S.C. 154(b) by 196 days.

(21) Appl. No.: 14/564,213

(22) Filed: Dec. 9, 2014

(51) Int. Cl.
*F41A 25/26* (2006.01)
*F42B 33/06* (2006.01)

(52) U.S. Cl.
CPC ..... *F41A 25/26* (2013.01); *F42B 33/067* (2013.01)

(58) Field of Classification Search
CPC ..... F42B 33/067; F41A 1/08; F41A 25/26; F41H 11/12
USPC ..... 89/42.01, 1.13, 37.1, 37.04, 37.05, 89/40.02, 40.05, 40.06, 40.14, 37.01; 86/50; 102/401, 402, 403; 42/94
See application file for complete search history.

(56) References Cited

U.S. PATENT DOCUMENTS 4,932,308 A * 6/1990 Arene ..... F41A 1/08 89/1.705
8,479,435 B1 * 7/2013 Gladwell ..... F41G 3/165 102/402
8,915,004 B1 * 12/2014 Langner ..... F42D 5/04 124/65
9,322,625 B1 * 4/2016 Langner ..... F41B 9/0046
2003/0041724 A1 * 3/2003 Ebersole, Jr. ..... F41A 25/06 89/42.01
2012/0180644 A1 * 7/2012 Langner ..... F42D 5/04 89/42.01
2014/0245878 A1 * 9/2014 Langner ..... F41A 25/06 86/50
2014/0245880 A1 * 9/2014 Rabec Le Gloahec ... F41G 3/00 89/1.13

* cited by examiner

*Primary Examiner* — John D Cooper
(74) *Attorney, Agent, or Firm* — Letham Law Firm LLC; Lawrence Letham

(57) ABSTRACT

A recovery system for recovering a disrupter after the disrupter has been fired to launch a projectile toward an explosive device. The recovery system includes a retainer that couples to the barrel of the disrupter, a slide that couples to the retainer, and a base that couples to a support. The slide removeably couples to the base. Responsive to a recoil force of firing the disrupter, the slide decouples from the base, and the disrupter, the slide, and the retainer moves away from the base and the support in a direction opposite a direction of travel of the projectile thereby completely separating the slide from the base. The disrupter may be recovered after separation from the base. The recovery system may further include a plunger that extends while the slide is removeably coupled to the base to retain the slide coupled to the base prior to firing the disrupter. Responsive to firing the disrupter, the plunger retracts to facilitate decoupling of the slide from the base.

15 Claims, 3 Drawing Sheets

METHODS AND APPARATUS FOR DISRUPTER RECOVERY

FIELD OF THE INVENTION

Embodiments of the present invention relate to disrupters, the aiming and support of disrupters prior to firing, and the recovery of disrupters after being fired.

BACKGROUND OF THE INVENTION

A disrupter launches (e.g., fires, propels, hurls) a projectile (e.g., bullet, water column, shot) at an explosive device (e.g., bomb, improvised explosive device) to disrupt (e.g., disable, destroy, incapacitate) the explosive device. Users of disrupters may benefit from a disrupter system that facilitates positioning (e.g., aiming) and supporting the disrupter prior to firing and recovering (e.g., getting back) the disrupter after firing.

BRIEF DESCRIPTION OF THE DRAWING

Embodiments of the present invention will now be further described with reference to the drawing, wherein like designations denote like elements, and.

DETAILED DESCRIPTION OF THE PREFERRED EMBODIMENTS

Figure 1:
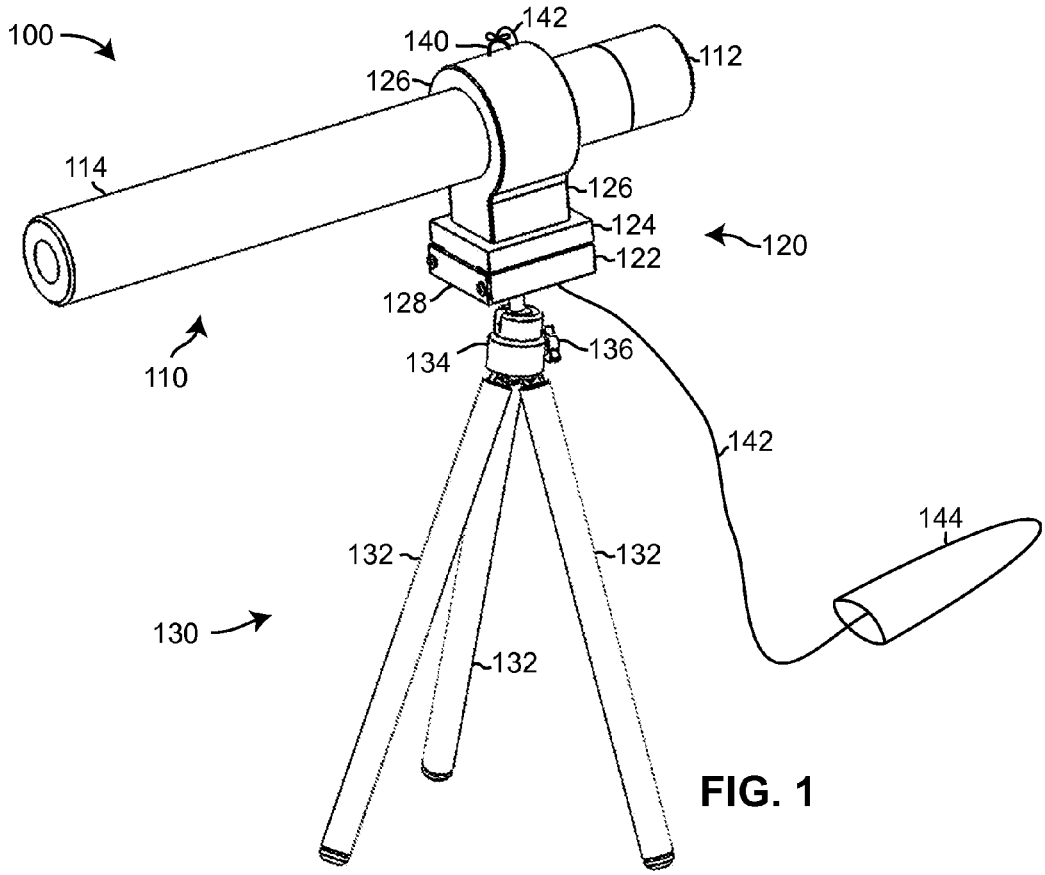
FIG. 1 is a plan perspective view of a disrupter system according to various aspects of the present invention.

A disrupter launches a projectile toward an explosive device to disrupt the explosive device. A disrupter system facilitates positioning the disrupter prior to launching the projectile so that the barrel and the trajectory of the projectile are oriented toward the explosive device. A disrupter system further facilitates recovery of the disrupter after firing the disrupter. Firing the disrupter results in a force of recoil operating on the disrupter. The force of recoil moves the disrupter, generally rapidly, from its position prior to firing the disrupter.

The disrupter system of the present invention performs the functions of a disrupter system in such a manner that the disrupter may include a muzzle brake attached to the muzzle of the barrel of the disrupter without interfering with the operation of the disrupter system. The muzzle brake may be structurally be larger (e.g., larger diameter) than the diameter of the barrel of the disrupter without interfering with the recovery operation of the disrupter after firing.

According to various aspects of the present invention, a disrupter system enables the disrupter to separate from the support that holds (e.g., supports) and positions the disrupter prior to firing the disrupter. The disrupter separates from the support responsive to the force of recoil. The disrupter system enables the disrupter to separate from the support to increase safety of operating the disrupter and to facilitate recovery of the disrupter.

Separation increases safety by leaving the support in its pre-firing position after firing the disrupter. If the disrupter does not separate from the support, the recoil force that rapidly moves the disrupter would also rapidly move the support possibly causing injury and damage as it twists through the air.

Separation of the disrupter from the support further permits the operator of the disrupter to more predictably select the direction in which the disrupter will move responsive to the recoil force. Separation of the disrupter from the support at an interface (e.g., boundary) between the disrupter and the support reduces the likelihood of having unpredictable forces applied by the support on the disrupter due to contact of the support with the ground. Whereas the terrain and slipperiness of the ground may change from one site (e.g., location) to another the interface that decouples between the disrupter and the support is consist for each operation of the disrupter, so the separation of the disrupter and movement of the disrupter after separation due to the recoil force is more consistent in different circumstances and more predictable. Predictability of movement of the disrupter responsive to the recoil force permits an operator to select a direction of flight of the disrupter in which the disrupter will not be damaged or cause damage.

Separation of the disrupter from the support further facilitates predictable deployment of an aerodynamic brake to slow the velocity of travel and the distance of travel of the disrupter responsive to the recoil force. If the disrupter does not separate from the support, the support may interfere with deployment of an aerodynamic brake thereby making recovery less predictable. If the disrupter does not separate from the support, the less predictable flight path of the disrupter makes it more difficult to reliably deploy an aerodynamic brake, limit the velocity (e.g., speed) of movement of the disrupter, and limit the distance of travel of the disrupter.

In an implementation, disrupter system 100 includes disrupter 110, recovery system 120, and support 130.

Disrupter 110 includes barrel 114 and firing mechanism 112. Disrupter 110 performs the functions of a disrupter discussed above. To operate disrupter 110 to disable an explosive device, a projectile (not shown) is placed inside of barrel 114. A charge (e.g., pyrotechnic, propellant) is place between the projectile and firing mechanism 112. Firing mechanism 112 ignites (e.g., fires, burns) the charge so that a rapidly expanding gas produced by the burning charge pushes (e.g., propels) the projectile out of barrel 114 toward the explosive device.

The projectile must be expelled (e.g., launched, propelled) from barrel 114 with sufficient force to strike the explosive device to disable or destroy the explosive device. The force of launch may be equivalent to the force of launching a bullet from a conventional firearm, such as a shot gun. Launching the projectile results in a force opposite the direction of travel of the projectile that is referred to above and herein as a recoil force or a force of recoil. The recoil force acts on the disrupter and any object coupled to the disrupter to move the disrupter in the direction opposite the direction of travel of the projectile.

Barrel 114 includes any conventional disrupter barrel. Firing mechanism 112 includes any conventional firing mechanism. Disrupter 110 includes any conventional disrupter including any attachments and/or accessories that may be coupled (e.g., attached) to disrupter 110, including muzzle brakes, fire suppressors, sights for aiming, and aiming devices.

A support includes any conventional support (e.g., rest, vise, pod, tripod, bag) for supporting disrupter 110 and recovery system 120. A support includes any conventional articulated structures for positioning (e.g., orienting) disrupter 110 in direction. A direction of orientation may include any direction with respect to any reference. For example, a direction of orientation of disrupter 110 may include up, down, left, right, forward, rearward, and any position (e.g., angle) in between with respect to support 130. An implementation of an articulated structure for positioning includes positioner 134.

In an implementation, support 130 includes legs 130, positioner 134, and knob 136.

Support 130 supports (e.g., holds) the weight of disrupter 110 and recover system 120 while disrupter 110 is positioned prior to firing disrupter 110. Support 130 supports disrupter 110 and recover system 120 while disrupter 110 is oriented in any position as discussed above. Support 130 may be stationary before, during, and/or after firing disrupter 110. Support 130 may have sufficient inertia to not move at all, or not move substantially, or remain upright, even when disrupter 110 and/or recover system 120 is subjected to a force that results from firing a projectile from disrupter 110. Positioner 134 may change is orientation with respect to legs 132 and therefore with respect to the ground to permit positioning of disrupter 110 while legs 132 remain in fixed positions. Knob 136 may be used to release (e.g., free) positioner 134 to move to position disrupter 110. Knob 136 may be used to tighten (e.g., fix) positioner 134 so that disrupter 110 no longer changes its position, but remains in a fixed position to aim disrupter 110 in a direction. Positioner 134 may couple to recover system 120 using any conventional coupling.

A recover system may operate to reduce transmission of a force that acts on disrupter 110 to support 130. A recover system may facilitate the separation of disrupter 110 from support 130 to reduce an amount of force transferred from disrupter 110 to support 130. A source of force that acts on disrupter 110 includes a force that occurs as a result of (e.g., incident to) launching a projectile (e.g., recoil force). A recover system may cooperate with support 130 and disrupter 110 to position disrupter 110 prior to launching a projectile. A recover system may cooperate with support 130 and disrupter 110 to aim disrupter 110 toward an explosive device prior to launching a projectile.

A recovery system operates to provide consistent separation of disrupter 110 from support 130 for repeated operations of disrupter 110. A recovery system operates to provide a consistent trajectory of movement for disrupter 110 responsive to a force of recoil. A recovery system operates to allow an operator to select a direction of movement of the disrupter 110 responsive to a recoil force. A recovery system may include an aerodynamic brake that deploys responsive to movement of disrupter 110. A recovery system operates to provide consistent deployment of an aerodynamic brake for repeated operations of disrupter 110. A recovery system operates to improve the safe operation of disrupter 110. A recovery system operates to prohibit decoupling of disrupter 110 form support 130 prior to firing disrupter 110. A recovery system operates to facilitate separation of disrupter 110 from support 130 for storage, transport, positioning of support 130, and/or loading of disrupter 110 for launching a projectile.

In an implementation, recovery system 120 performs the functions of a recover system discussed above. Recovery system 120 includes base 122, slide 124, and retainer 126. Base 122 couples to positioner 134 using any conventional coupling. Base 122 removeably couples to slide 124. Base 122 may couple to slide 124 prior to launching a projectile. Base 122 may remain coupled to slide 124 while disrupter 110 is positioned (e.g., aimed). Base 122 may remain coupled to slide 124 as a projectile is being launch and as the force of recoil acts on the disrupter 110 and recovery system 120 up to a predetermined magnitude of force. The predetermined magnitude of force is determined by a force of interference provided by plunger 310 as discussed below. As the force of recoil exceeds the predetermined magnitude, side 124 begins to move with respect to base 122 so that slide 124 separates from base 122. The force of recoil that acts on disrupter 110 acts on slide 124 via retainer 126 to decouple slide 124 from base 122.

The separation of base 122 and base 122 limits the transfer of the recoil force from disrupter 110 to support 130. Decreasing the predetermined magnitude of the force required to separate slide 124 from base 122 decreases the amount of recoil force transferred from disrupter 110 to support 130.

Retainer 126 couples to disrupter 110, preferably barrel 114 of disrupter 110. Retainer 126 remains coupled to barrel 114 before, during, and after a projectile is launched from disrupter 110. In an implementation, retainer 126 is omitted and slide 124 is coupled directly to disrupter 110 and slide 124 performs the functions of slide 124 and retainer 126 discussed herein. The portion of retainer 126 that couples to barrel 114 may be different for different types of types, makes, sizes, and shapes of disrupters, while the coupling to slide 124 may be consistent for all version of retainer 126 thereby providing consistency in operation and manufacture of recovery system 120.

Slide 124 couples to retainer 126 using any conventional coupling. Slide 124 remains coupled to retainer 126 before, during, and after a projectile is launched from disrupter 110. Barrel 114 does not separate from retainer 126. In an implementation, retainer 126 may include a passage (e.g., bore). Barrel 114 may be positioned (e.g., inserted) in the passage. Retainer 126 may couple to barrel 114 in such a manner that the interior surface of the retainer 126 clamps to (e.g., grasps, interferes with) an outer surface of barrel 114 to couple to barrel 114. A diameter of the passage may be suitable for clamping to a particular part of barrel 114 to provide better holding ability and balancing of the barrel on support 130 while in use. An interior surface of the passage may include any structure (e.g., texture, protrusions) to facilitate clamping to barrel 114. Barrel 114 may include specific structures (e.g., bores, protrusions) and retainer 126 or the passage of retainer 126 may include matching (e.g., mated) structures for coupling.

In another implementation, retainer 126 is implemented in two pieces. A bottom portion of retainer 126 couples to slide 124 in any conventional way. Barrel 114 is positioned in the bottom portion of retainer 126. The top portion of retainer 126 is positioned over barrel 114. Coupling the top portion of retainer 126 to the bottom portion of retainer 126 couples barrel 114 to retainer 126 so that barrel 114 remains coupled to retainer 126 before, during, and after firing disrupter 110. A two-piece retainer 126 may be used when barrel 114 does not have a substantially constant diameter along the length thereof due to tapering, areas of greater diameter and/or attachments positioned on barrel 114.

Retainer 126 may couple to barrel 114 and recovery system 120 may perform the functions of a recovery system without requiring barrel to fit (e.g., slip, pass) through the passage in retainer 126, so barrel 114 does not need to have a consistent shape (e.g., round) along its length. Further, accessories such as a muzzle brake may be coupled to barrel 114 without interfering with the functions of recovery system 120.

Base 122 includes groove (e.g., mortise) 210, cap (e.g., plate) 128, bore 230, cavity (e.g., hollow, recess) 232, and surfaces 212, 214, 216, 220, and 222. Slide 124 includes protrusion (e.g., tenon) 260, bore 282, bolt 280, bore 270, plunger 310, and surfaces 312, 250, 252, 320, and 322.

Figure 2:
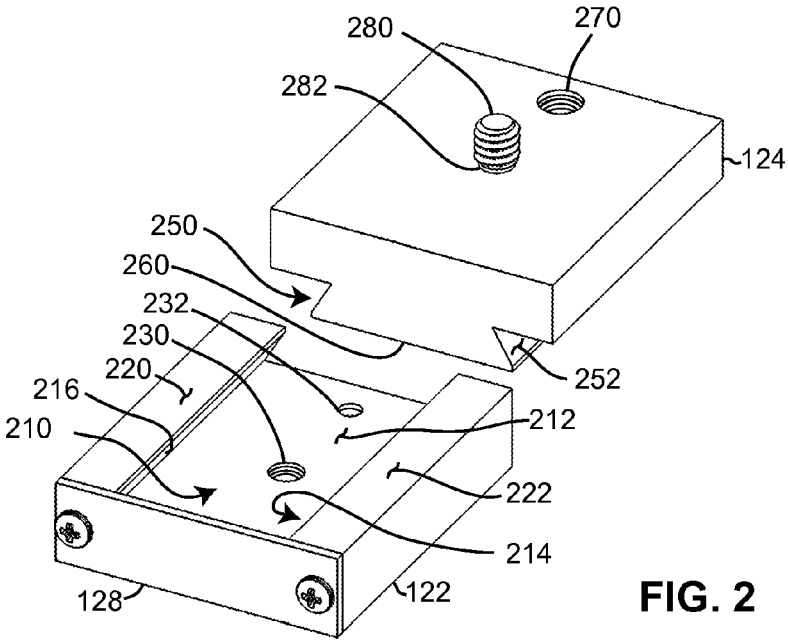
FIG. 2 is a perspective plan view of the front, top, and right side of a slide and a base of the recovery system of FIG. 1 while separated.
Figure 3:
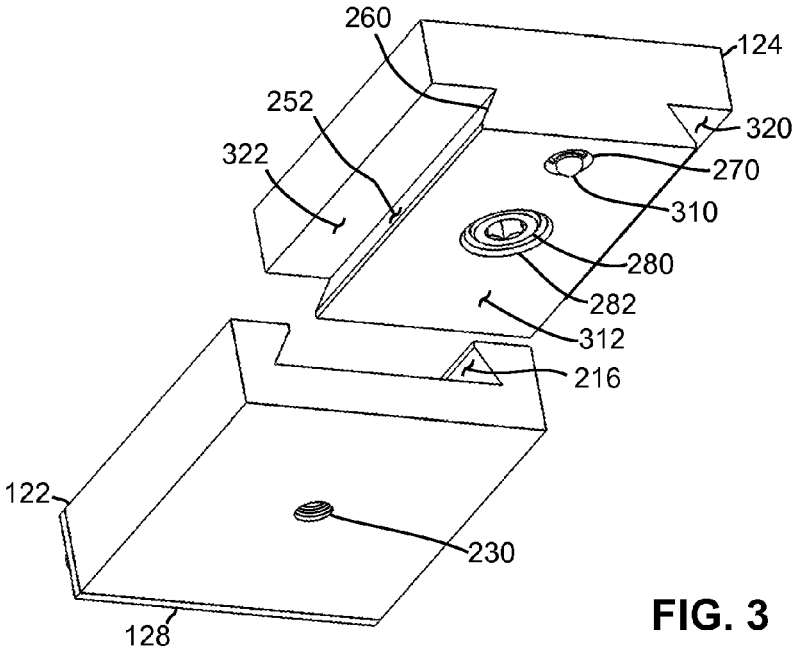
FIG. 3 is a perspective plan view of the back, bottom, and right side of the slide and the base of the recovery system of FIG. 1 while separated.
Figure 4:
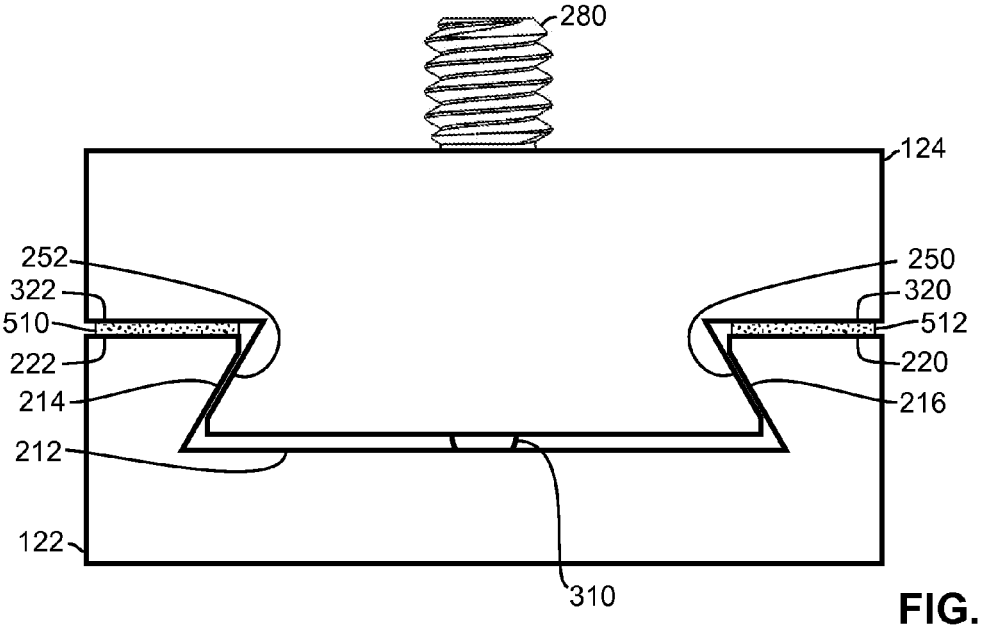
FIG. 4 is a rear plan view of the slide and the base of the recovery system of FIG. 1 while removeably coupled.
Figure 5:
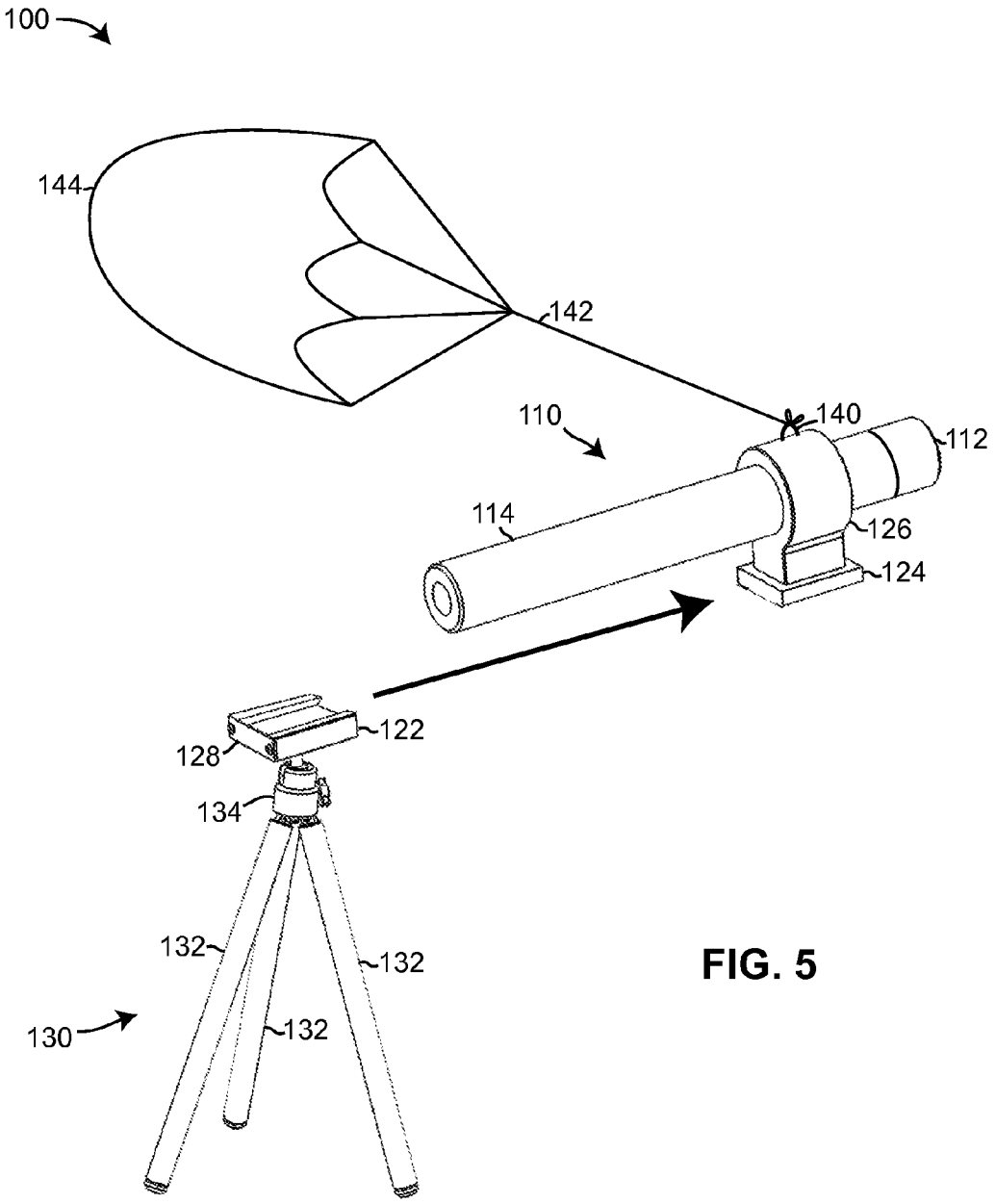
FIG. 5 is a plan perspective view of the disrupter system of FIG. 1 after firing the disrupter.

Protrusion 260 slides (e.g., moves) in groove 210. Protrusion 260 enters groove 210 through an opening in a rear, with respect to FIG. 2 and the direction of flight of a launched projectile, wall of base 122. A top wall of base 122 includes an opening that defines a length of groove 210. Protrusion 260 enters groove 210 via the opening in the rear wall and moves along groove 210 while a portion of slide 124 extends through the opening in the top wall. Protrusion 260 continues to move forward in groove 210 until a portion of slide 124 contacts a wall (e.g., front wall with respect to the direction of travel of a projectile) of base 122 opposite the rear wall. Cap 128 forms a portion of the front wall of base 122. Cap 128 stops forward movement of protrusion 260 in groove 210 and forward movement of slide 124 with respect to base 122.

Surfaces 250 and 252 of slide 124 and surfaces 214 and 216 are formed at an angle with respect to the plane of movement of protrusion 260 with respect to groove 210. Interference of surfaces 214 and 216 with surfaces 252 and 250 respectively, prohibits protrusion 260 from exiting groove 210 via the opening in the top of base 122. In other words, surfaces 214, 216, 250, and 252 are angle so that while protrusion 260 is positioned in groove 210, interference between surfaces 214 and 216 with surfaces 252 and 250 respectively prohibits movement of slide 124 away from base 122 in a vertical, with respect to FIG. 2, direction. Cap 128 prohibits protrusion from exiting groove 210 in a forward direction. Protrusion 260 may exit groove 210 only by moving in a rearward direction (e.g., away from cap 128 and with respect to the direction of travel of the projectile) with respect to base 122 so that protrusion 260 exits groove 210 via the opening in the rear wall of base 122. The limitations in movement imposed by (e.g., that result from) cap 128 and surfaces 214, 216, 250, and 252 constrain the movement of slide 124 to base 122 to along the plane of surface 212 and rearwardly.

Because the force of recoil is directed in the rearward direction, the recoil force may act to move protrusion 260 out of groove 210 subject to the force applied by plunger 310 as discussed herein. Movement of protrusion 260 completely out of groove 210 results in complete separation of slide 124 from base 122.

Moving protrusion 260 forward in groove 210 until slide 124 contacts the front wall of base 122 positions plunger 310 over cavity 232. Plunger 310 is biased by a resilient force to extend beyond surface 312. When extended, plunger 310 enters cavity 232.

Plunger 310 operates to retain slide 124 coupled to base 122. As discussed above, a resilient force acts to move plunger 310 outward from surface 312 and into cavity 232. Interference between plunger 310 with the sides of cavity 232 operates to retain protrusion 260 in groove 210 and slide 124 coupled to base 122. However, a force of recoil exerts a force of such a magnitude on plunger 310 that it overcomes the resilient force of plunger 310 and forces plunger 310 to retract from cavity 232 and into bore 270 thereby freeing slide 124 to decouple and separate from base 122. The resilient force exerted on plunger 310 is proportional to the amount (e.g., magnitude) of recoil force required to move plunger 310 into bore 270 and out of cavity 232.

In the absence of a recoil force, before disrupter 110 is fired, the resilient force that extends plunger 310 provides sufficient force to retain plunger 310 in cavity 232 while disrupter 110, and therefore cap 128, is positioned in an upward direction, with respect to FIG. 1. When disrupter 110 is oriented toward the ground (e.g., downward), cap 128 retains slide 124 in grove 210. When disrupter 110 is oriented in a level positioned, slight forces of friction (e.g., drag) in addition to plunger 310, maintain slide 124 in grove 210. When disrupter 110 is oriented upward, gravity acts on disrupter 110 and slide 124 to move protrusion 260 out of groove 210 via the opening in the rear wall of base 122. Absent plunger 310, gravity would separate slide 124 and base 122 while disrupter 110 is positioned in an upward direction. However, the force exerted by plunger 310 and the force of interference between plunger 310 and the sides of cavity 232 is sufficient to retain plunger 310 in cavity 232, protrusion 260 in groove 210, and slide 124 coupled to base 122. The resilient force exerted on plunger 310 is sufficient so that a force of gravity cannot pull protrusion 260 from groove 210 while disrupter 110 is oriented upward. However, because a recoil force is greater than the force of gravity, the recoil force overcomes the resilient force of plunger 310 so that plunger 310 retracts into bore 270 thereby freeing protrusion 260 to move out of groove 210 such that slide 124 separates and moves away from base 122.

In another implementation, plunger 310 couples to base 122 and cavity 232 is formed in slider 124 and cooperate to perform the coupling and releasing functions discussed herein.

In another implementation, plunger 310 may be omitted when in use the muzzle of disrupter 110 will only be oriented level with respect to gravity or downward (e.g., closer to ground than base 122, angled toward ground) toward an explosive device and not upward where gravity may act to pull slide 124 away from base 122.

Separation of slide 124 from base 122 responsive to a recoil force limits the transfer of the recoil force to support 130. Limiting the transfer of the recoil force to support 130 leaves support 130 in place during and after launching a projectile instead of moving (e.g., flying) in an uncontrolled manner responsive to the recoil force. Movement of support 130 in an uncontrolled manner may result in injury or death to people, animals, or property.

Ease of movement of protrusion 260 from groove 210 and the amount of the recoil force transferred to support 130 is related to the friction between surfaces 212, 214, 216, 220, and 222 and surfaces 312, 252, 250, 320, and 322 respectively. Increased friction between surfaces 212, 214, 216, 220, and 222 and surfaces 312, 252, 250, 320, and 322 results in a greater transfer of the recoil force to the support. If surfaces 212, 214, 216, 220, and 222 and surfaces 312, 252, 250, 320, and 322 were to catch with (e.g., stick to, interfere with) each other, a sufficient amount of the recoil force could be transferred to support 130 to move and/or destabilize support 130.

If the transfer of recoil force to support 130 is limited so that support 130 remains stable and in place, the trajectory of disrupter 110 as it moves in response to the recoil force is predictable and precautions may be made to protect against injury cause by the forceful movement of disrupter 110. Further, knowing how and where disrupter 110 will move responsive to a recoil force permits prior planning for recovery of disrupter 110.

The magnitude of the energy transferred from slide 124 to base 122, and therefore support 130, depends on the amount of energy that can be transferred from the surfaces of slide 124 to the surfaces of base 122. Reducing the friction between surfaces 212, 214, 216, 220, and 222 and surfaces 312, 252, 250, 320, and 322 reduces the amount of energy that can be transferred from slide 124 to base 122 and to support 130.

A slippery or low friction coating (e.g., material) between the surfaces of slide 124 and the surfaces of base 122 reduces the friction between the surfaces and the amount of recoil force transferred to support 130. Materials that may be used for friction (e.g., drag) reducing coatings may include polytetrafluoroethylene polymers (e.g., PTFE, Teflon), polyethylene, diamond-reinforced PTFE, titanium-reinforced PTFE, and other polymers (e.g., hydrophobic polymers) that reduce drag. A friction reducing coating may be in the form of a tape where one side of the tape adheres to surface of slide 124 and the slippery surface of the tape is positioned against the opposing surface on base 122 or vise versa.

A drag reducing coating may be placed on some or all of the surfaces of base 122 and slide 124. For example, coating only surface 322 or 222 and surface 320 or 220 reduces the fiction between base 122 and slide 124 sufficient so that protrusion 260 may exit groove 210 without destabilizing support 130. In an application, friction reducing coating 512 is applied to surfaces 322 and 320 to reduce the friction between surfaces 322 and 222 and surfaces 320 and 220. In other applications, a drag reducing coating may be placed between all surfaces that may contact each other such as between 322 and 222, 252 and 214, 212 and 312, 216 and 250, and 320 and 220.

Testing has shown that applying a friction reducing coating results in a transfer of energy from disrupter 110 during firing to support 130 that is so minimal that a disrupter weighing about three pounds does not result in visible movement to the naked eye of a support that weighs about six ounces.

Preferably applying a friction reducing coating should provide a dry coating so that when disrupter 110 is used outdoors, dirt does not stick to the coating if disrupter 110 comes to rest on the ground after firing. Friction reducing coatings that are applied as a dry (e.g., not sticky, not adhesive) coating may be cleaned of dirt and/or debris by hand for proper performance in a subsequent firing. Durable coatings that apply dry may be used for many firings with minimal maintenance that may be performed in the field and rapidly between subsequent firings.

Retainer 126 couples to barrel 114 of disrupter 110. Retainer 126 couples to barrel 114 using any conventional coupling. Retainer 126 remains coupled to barrel 114 before, during, and after launch of a projectile. Retainer 126 may be removed for storage if convenient. Retainer 126 couples to slide 124 using any conventional coupler.

In an implementation, retainer 126 includes a threaded bore (not shown). Slide 124 includes bore 282. Bolt 280 passes through bore 282 and threads into the bore in retainer 126 to couple slide 124 to retainer 126. Slide 124 remains coupled to retainer 126 before, during, and after launch of a projectile. Retainer 126 is not decoupled from slide 124 responsive to the recoil force of launching a projectile.

Plunger 310 may be inserted into bore 270 to position plunger 310 over cavity 232 when protrusion 260 is inserted into groove 210 and slide 124 is positioned proximate to cap 128. Bore 270 may permit adjustment of the position and depth of penetration of plunger 310 into cavity 232 using any conventional structures. In an implementation, plunger 310 includes a threaded body that threads into bore 270 so that turning the body in one direction positions plunger 310 deeper into cavity 232 and turning the body in the opposite direction retracts plunger 310 from cavity 232.

Recovery system 120 may include an aerodynamic brake. An aerodynamic brake may deploy responsive to movement of disrupter 110. An aerodynamic brake may slow the speed of separation of disrupter 110 from support 130 responsive to launching a projectile. An aerodynamic brake may limit the distance traveled by disrupter 110 away from support 130 responsive to launching a projectile.

In an application the aerodynamic brake includes parachute 144. Parachute 144 couples to anchor 140 on retainer 126. Cord (e.g., lanyard) 142 couples parachute 144 to anchor 140. Prior to launch, parachute 144 may be laid on the ground. Prior to launch, parachute 144 may be stowed in a container (e.g., tube) (not shown) coupled to support 130 or base 122. The container may include an open end through which parachute 144 exits the container when deployed. A pulling force exerted by anchor 140 on cord 142 deploys parachute 144. Movement of disrupter 110 results in anchor 140 exerting a pulling force.

In operation, retainer 126 is coupled to barrel 114. Slide 124 is coupled to retainer 126. Base 122 is coupled to positioner 134. An operator loads a projectile and a pyrotechnic, usually packaged together in the form of a cartridge, into disrupter 110. The projectile and pyrotechnic includes any conventional projectile and pyrotechnic. The operator prepares firing mechanism 112 to ignite the pyrotechnic to launch the projectile. The pyrotechnic may be ignited in any conventional manner.

The operator of disrupter system 100 inserts protrusion 260 into cavity 232 and moves slide 124 forward toward cap 128. The operator must exert enough force when moving protrusion 260 forward in groove 210 so that plunger 310 retracts when it comes into contact with the rear edge of base 122. Plunger 310 remains retracted and contracts surface 212 until plunger 310 is positioned over cavity 232. Once plunger 310 is positioned over cavity 232, plunger 310 extends into cavity 232 to retain protrusion 260 in groove 210 until a force of recoil forces plunger 310 out of cavity 232.

The operator positions (e.g., aims) barrel 114 by loosening knob 136 and orienting barrel 114 toward the explosive device to be disrupted. Disrupter 110 may include any conventional sighting device for aiming disrupter 110 including a sight and a laser. Disrupter 110 may assume any orientation as discussed above. After aiming is completed, the operator tightens knob 136 so that disrupter 110 retains its orientation toward the explosive device.

While positioning support 130 and aiming disrupter 110, the operator may investigate whether there are any obstacles or objects in the recoil path of disrupter 110 when it separates from support 130. The operator may position support 130 and aim disrupter 110 in such a manner so as to reduce the likelihood of injury or damage caused by impact of disrupter 110 with an obstacle or object along the recoil trajectory of disrupter 110.

The operator ignites the pyrotechnic to launch the projectile. The force of launching the projectile out barrel 114 causes the recoil force. The recoil force acts to move disrupter 110 in a direction opposite the direction of aiming. Because barrel 114 is oriented in the same direction that cap 128 is oriented, the force of recoil will operate to move protrusion 260 out of groove 210 via the opening in the rear wall of base 122. Plunger 310 will, at first, resist (e.g., stop, slow down, retard) movement of protrusion 260 out of groove 210 because of the interference between plunger 310 and the sides of cavity 232. However, as the force of recoil increases, plunger 310 will be forced into bore 270 and to withdraw from cavity 232 so that protrusion 260 moves out of groove 210.

Rapid movement of protrusion 260 out of groove 210 permits slide 124 to rapidly separate completely from base 122. As discussed above, friction reducing coatings 510 and 512 reduce the drag between slide 124 and base 122, so that only a small proportion of the recoil force that acts on disrupter 110, retainer 126, and slide 124 is translated (e.g., transferred) to base 122 and support 130. Support 130 remains in place without moving or with only slight movement in response to the recoil force. Support 130 does not tilt onto less its total number of legs or fall over responsive to firing disrupter 110.

Rapid movement of disrupter 110 and thus retainer 126 applies a pulling force on cord 142. The force on cord 142 deploys parachute 144. Parachute 144 applies a force (e.g., drag) on disrupter 110 that retards the speed of travel of disrupter 110. Because parachute 144 applies a drag force on disrupter 110, parachute 144 may limit the distance traveled by disrupter 110 responsive to launching a projectile.

When disrupter 110 comes to rest after firing a projectile, the operator may recover disrupter 110 for subsequent firings.

The foregoing description discusses preferred embodiments of the present invention, which may be changed or modified without departing from the scope of the present invention as defined in the claims. Examples listed in parentheses may be used in the alternative or in any practical combination. As used in the specification and claims, the words 'comprising', 'including', and 'having' introduce an open ended statement of component structures and/or functions. In the specification and claims, the words 'a' and 'an' are used as indefinite articles meaning 'one or more'. When a descriptive phrase includes a series of nouns and/or adjectives, each successive word is intended to modify the entire combination of words preceding it. For example, a black dog house is intended to mean a house for a black dog. While for the sake of clarity of description, several specific embodiments of the invention have been described, the scope of the invention is intended to be measured by the claims as set forth below. In the claims, the term "provided" is used to definitively identify an object that not a claimed element of the invention but an object that performs the function of a workpiece that cooperates with the claimed invention. For example, in the claim "an apparatus for aiming a provided barrel, the apparatus comprising: a housing, the barrel positioned in the housing", the barrel is not a claimed element of the apparatus, but an object that cooperates with the "housing" of the "apparatus" by being positioned in the "housing".

What is claimed is:

1. A recovery system for recovering a provided disrupter after the disrupter has been fired to launch a provided projectile toward a provided explosive device, the recovery system comprising:

a retainer having a passage therethrough, a provided barrel of the disrupter positioned in the passage, the retainer coupled to the barrel such that the retainer remains coupled to the barrel before, during, and after firing the disrupter;

a slide, the slide coupled to the retainer, the slide remains coupled to the retainer before, during, and after firing the disrupter;

a base, the base coupled to a provided support, the base remains coupled to the support before, during, and after firing the disrupter;

the slide removeably couples to the base;

responsive to a recoil force of firing the disrupter, the slide decouples from the base, and the disrupter, the slide, and the retainer move away from the support in a direction opposite a direction of travel of the projectile thereby completely separating the slide from the base.

2. The recovery system of claim 1 further comprising a plunger wherein:

the plunger is coupled to one of the slide and the base;

while the slide is coupled to the base, the plunger extends to interfere with one of the base and the slide to retain the slide coupled to the base prior to firing the disrupter; and responsive to the recoil force of firing the disrupter, the plunger retracts so that the slide decouples from the base.

3. The recovery system of claim 1 wherein:

the slide comprises a protrusion;

the base comprises a groove;

the protrusion slides into the groove to couple the slide to the base.

4. The recovery system of claim 1 further comprising an aerodynamic brake wherein:

movement of the disrupter away from the support deploys the aerodynamic brake to slow and limit movement of the disrupter.

5. The recovery system of claim 4 wherein the aerodynamic brake comprises a parachute.

6. The recovery system of claim 1 further comprising a coating for reducing friction between at least one surface of the slide and at least one surface of the base to:

facilitate separation of the slide from the base responsive to the force of recoil; and reduce an amount of the force of recoil transferred to the support.

7. The recovery system of claim 1 wherein the interference between the plunger and the base retains the slide coupled to the base regardless of the orientation of the disrupter with respect to the support.

8. A recovery system for recovering a provided disrupter after the disrupter has been fired to launch a provided projectile toward a provided explosive device, the recovery system comprising:

a retainer having a passage therethrough, a provided barrel of the disrupter positioned in the passage, the retainer coupled to the barrel such that the retainer remains coupled to the barrel before, during, and after firing the disrupter;

a slide, the slide coupled to the retainer, the slide remains coupled to the retainer before, during, and after firing the disrupter, the slide comprising a protrusion;

a base, the base coupled to a provided support, the base remains coupled to the support before, during, and after firing the disrupter, the base comprising a groove, the groove open on a first side and a second side of the base; wherein:

the protrusion enters the groove via the opening on the first side, a side of the protrusion interferes with a side of the groove so that the protrusion cannot exit the groove via the opening on the second side, while the protrusion is positioned in the groove;

the opening on the first side is oriented in a direction opposite a direction of travel of the projectile; and responsive to a force of recoil of firing the disrupter:

the protrusion moves out of the groove via the opening in the first side to decouple the slide from the base; and the disrupter, the slide, and the retainer move away from the support in the direction opposite the direction of travel of the projectile.

9. The recovery system of claim 8 further comprising a plunger wherein:

the plunger is coupled to one of the slide and the base;

while the protrusion is positioned in the groove, the plunger extends to interfere with one of the base and the slide to retain the protrusion in the groove prior to firing the disrupter; and responsive to the recoil force of firing the disrupter, the plunger retracts so that the protrusion exits the groove and the slide decouples from the base.

10. The recovery system of claim 8 further comprising a coating for reducing friction between at least one surface of the slide and at least one surface of the base to:

facilitate separation of the slide from the base responsive to the force of recoil; and reduce an amount of the force of recoil transferred to the support.

11. The recovery system of claim 8 further comprising an aerodynamic brake wherein:

movement of the disrupter away from the support deploys the aerodynamic brake to slow and limit movement of the disrupter.

12. The recovery system of claim 11 wherein the aerodynamic brake comprises a parachute.

13. The recovery system of claim 8 wherein the interference between the plunger and the side of the groove retains the slide coupled to the base regardless of the orientation of the disrupter with respect to the support.

14. A recovery system comprising:

a disrupter, the disrupter comprising a barrel, the disrupter for launching a provided projectile toward a provided explosive device to disrupt the explosive device;

a retainer having a passage therethrough, the barrel positioned in the passage, the retainer coupled to the barrel such that the retainer remains coupled to the barrel before, during, and after firing the disrupter;

a slide, the slide coupled to the retainer, the slide remains coupled to the retainer before, during, and after firing the disrupter, the slide comprising a protrusion;

a base, the base comprising a groove, the groove open on a first side and a second side of the base;

a support, the base coupled to the support, the base remains coupled to the support before, during, and after firing the disrupter; the support supports the weight of the disrupter, the retainer, the slide, and the base prior to firing the disrupter; wherein:

prior to firing:

the protrusion is positioned in the groove via the opening on the first side, a side of the protrusion interferes with a side of the groove so that the protrusion cannot exit the groove via the opening on the second side, while the protrusion is positioned in the groove;

the support supports the disrupter, the retainer, the slide, and the base for aiming the disrupter toward a provided explosive device, the support positioned upright and in a location;

the opening on the first side of the base is oriented in a direction opposite a direction of travel of the projectile responsive to launching the projectile:

the protrusion moves out of the groove via the opening in the first side to decouple the slide from the base;

the disrupter, the retainer, and the slide move away from the base and the support in the direction opposite the direction of travel of the projectile for later recovery.

15. The recovery system of claim 14 further comprising a plunger wherein:

the plunger is coupled to one of the slide and the base;

while the protrusion is positioned in the groove, the plunger extends to interfere with one of the base and the slide to retain the protrusion in the groove prior to firing the disrupter; and responsive to the recoil force of firing the disrupter, the plunger retracts so that the protrusion exits the groove and the slide decouples from the base.

* * * * *